US006607030B2

(12) United States Patent
Bauer et al.

(10) Patent No.: US 6,607,030 B2
(45) Date of Patent: Aug. 19, 2003

(54) FLUID-DRIVEN ALTERNATOR HAVING AN INTERNAL IMPELLER

(75) Inventors: William H. Bauer, Los Gatos, CA (US); Edward C. Fraser, Cupertino, CA (US); Henry More, Los Altos, CA (US)

(73) Assignee: Reuter-Stokes, Inc., Schenectady, NY (US)

( * ) Notice: Subject to any disclaimer, the term of this patent is extended or adjusted under 35 U.S.C. 154(b) by 111 days.

(21) Appl. No.: 09/464,310

(22) Filed: Dec. 15, 1999

(65) Prior Publication Data

US 2002/0162654 A1 Nov. 7, 2002

Related U.S. Application Data

(60) Provisional application No. 60/112,334, filed on Dec. 15, 1998.

(51) Int. Cl.[7] ..... E21B 43/00
(52) U.S. Cl. ..... 166/65.1; 166/66.5
(58) Field of Search ..... 166/65.1, 66.5; 290/54; 175/40

(56) References Cited

U.S. PATENT DOCUMENTS

| | | | | |
|---|---|---|---|---|
| 4,396,071 A | * | 8/1983 | Stephens | 175/50 |
| 4,532,614 A | * | 7/1985 | Peppers | 367/81 |
| 5,285,204 A | | 2/1994 | Sas-Jaworsky | 340/854.9 |
| 5,517,464 A | | 5/1996 | Lerner et al. | 367/84 |
| 5,626,200 A | * | 5/1997 | Gilbert et al. | 175/40 |
| 5,839,508 A | | 11/1998 | Tubel et al. | 166/65.1 |
| 5,965,964 A | | 10/1999 | Skinner et al. | 310/15 |

FOREIGN PATENT DOCUMENTS

| | | | |
|---|---|---|---|
| EP | 681090 | 11/1995 | E21B/47/18 |
| EP | 747568 | 12/1996 | E21B/41/00 |
| GB | 2081983 | 2/1982 | H02K/7/18 |

* cited by examiner

*Primary Examiner*—William Neuder
(74) *Attorney, Agent, or Firm*—Sutherland Asbill & Brennan LLP

(57) ABSTRACT

A fluid-driven alternator for use in a downhole well bore having fluid flowing therethrough includes a housing and an internal impeller rotatably mounted in the housing. A stator and rotor are mounted within the housing, and the internal impeller is coupled to the rotor. Fluid flowing through the housing rotates the impeller which in turn rotates the rotor. A flow diverter can be provided to direct fluid into the housing.

20 Claims, 3 Drawing Sheets

FLUID-DRIVEN ALTERNATOR HAVING AN INTERNAL IMPELLER

CROSS-REFERENCE TO RELATED APPLICATION

This application claims the benefit of provisional application No. 60/112,334, filed Dec. 15, 1998.

BACKGROUND OF THE INVENTION

1. Field of the Invention

The invention relates generally to an apparatus for generating electrical power in a downhole well bore. More particularly, the invention relates to a fluid-driven alternator that includes an internal impeller.

The alternator is located downhole within a drilling string and is typically used to generate electrical power near the drill-bit in an oil well, gas well or the like. Mud, or drilling fluid, is circulated through the well bore as part of the drilling process and this flow is used to drive the alternator. The generated power is used, for example, to operate a downhole measurement-while-drilling (MWD) tool. MWD tools acquire drilling-related data (e.g., pressure, temperature, orientation, etc.) from sensors near the drill bit at the bottom of the well bore and transmit the data to the surface.

2. Description of the Related Art

There are several known ways to provide the electric power necessary to operate MWD tools.

One conventional manner for providing electricity to downhole MWD tools is through a power cable connected from the surface through the drill string to the tool. This method suffers from the disadvantage of causing significantly increased rig time to be consumed because the cable must be retrieved from the well to enable each new section of drill pipe to be added and then re-installed.

Another conventional manner for providing electricity to downhole MWD tools is through the use of high-temperature batteries, typically Lithium Thionyl Chloride batteries. However, these batteries are expensive to build, difficult (and dangerous) to deploy logistically, and troublesome to dispose of when depleted. Furthermore, batteries have a short usable life, and the entire MWD tool must be removed in order to replace depleted batteries. Removing the MWD tool for the sole purpose of replacing batteries is very time consuming and costly.

A third conventional manner for providing electricity to downhole MWD tools is through the use of a mud-driven alternator assembly. Known alternators operate with external impeller blades that extend into the normal annular mud flow path around the MWD tool assembly. The mud flow rotates the external impellers, which drive the alternator to continuously generate power. This configuration is acceptable for a non-retrievable MWD tool; however, it is not suitable for a retrievable MWD tool where the complete tool must be removed through the drill string without getting caught and without damaging the assembly. The external impeller blades are unprotected and increase the outer diameter of the alternator assembly, thereby making it difficult to withdraw the alternator through a restricted section of the drill string.

SUMMARY OF THE INVENTION

It is a general object of the present invention to provide an impeller device of a fluid-driven alternator that overcomes the disadvantages of the conventional power-supplying devices.

It is another object of the present invention to provide an impeller device of a fluid-driven alternator that allows the assembly to be retrieved from within the drill string without getting caught or being damaged.

It is still another object of the present invention to provide an impeller device of a fluid-driven alternator where the impeller device has an internal impeller.

It is yet another object of the present invention to provide an impeller device of a fluid-driven alternator also having a flow diverter to divert the fluid flow to the internal impeller of the impeller device.

It is another object of the present invention to provide an impeller device of a fluid-driven alternator also having a flow diverter to divert the fluid flow to an internal impeller of the impeller device, where the upper speed (rpm) of the internal impeller is reduced.

In accordance with the objects described above, one aspect of the present invention includes a housing, an internal impeller rotatably mounted in the housing, a stator mounted within the housing, and a rotor rotatably mounted in the housing and coupled to the impeller. The housing includes at least one entrance opening and at least one exit opening, and the impeller includes at least one impeller blade and a drive shaft. Fluid flowing through the housing rotates the impeller thereby rotating the rotor.

In another aspect of the present invention, the alternator described above further includes a flow diverter on an exterior of the housing and located between the entrance and exit openings. The flow diverter restricts fluid flow in a flow path along the housing and directs at least some of the flowing fluid into the entrance opening.

In yet another aspect of the present invention, the flow diverter described above is molded onto the housing, includes at least one diverter ring made of an elastomer material and is capable of flexing at a predetermined rate of fluid flow to reduce the restriction.

In still another aspect of the present invention, the flow diverter described above is removably attached to the housing, includes at least one diverter ring made of an elastomer material and is capable of flexing at a predetermined rate of fluid flow to reduce the restriction.

In still another aspect of the present invention, the flow diverter described above is removably attached to the housing, includes a plurality of diverter rings made of an elastomer material and is capable of flexing at a predetermined rate of fluid flow to reduce the restriction.

In another aspect of the present invention, a fluid-driven alternator for use in a downhole well bore having fluid flowing therethrough includes a housing containing an upper bearing assembly, a lower bearing assembly and an impeller. The impeller has an upper end, a lower end and at least one impeller blade, and is rotatably attached at the upper end to the upper bearing assembly and at the lower end to the lower bearing assembly. The impeller is also coupled at one end to a rotor, which is part of an alternator assembly. The alternator assembly also includes an alternator stator. The housing has at least one entrance opening near the upper end of the impeller and at least one exit opening near the lower end of the impeller. Fluid enters the housing through the entrance opening, flows over the impeller blade, and exits the housing through the exit opening. The fluid flowing over the impeller blade rotates the impeller in the upper and lower bearing assemblies, thereby rotating the rotor of the alternator assembly.

According to yet another aspect of the present invention, the alternator further includes a flow diverter on an exterior of the housing. The flow diverter restricts fluid flow around the housing and diverts at least some of the fluid flow into the housing through the entrance opening.

According to still another aspect of the present invention, the flow diverter includes a plurality of flexible rings that deflect as a force of the fluid flowing on the diverter rings increases with an increase in a flow of the fluid, and the fluid flowing into the entrance opening of the housing tends to flatten off at the upper end of a fluid flow range for the impeller.

According to another aspect of the present invention, a fluid-driven alternator includes an internal impeller, housing means for housing and rotatably mounting the internal impeller, and alternator means, including a rotor and a stator, coupled to the internal impeller for generating electricity. The internal impeller is rotated by fluid flowing through the housing means and in turn rotates the rotor.

In yet another aspect of the present invention, the alternator further includes flow diverter means for diverting fluid flow into the housing means.

These and other aspects, objects, and features of the present invention will become apparent from the following detailed description of the preferred embodiments of the present invention, read in conjunction with reference to the accompanying drawings.

DETAILED DESCRIPTION OF THE PREFERRED EMBODIMENTS

Figure 1:
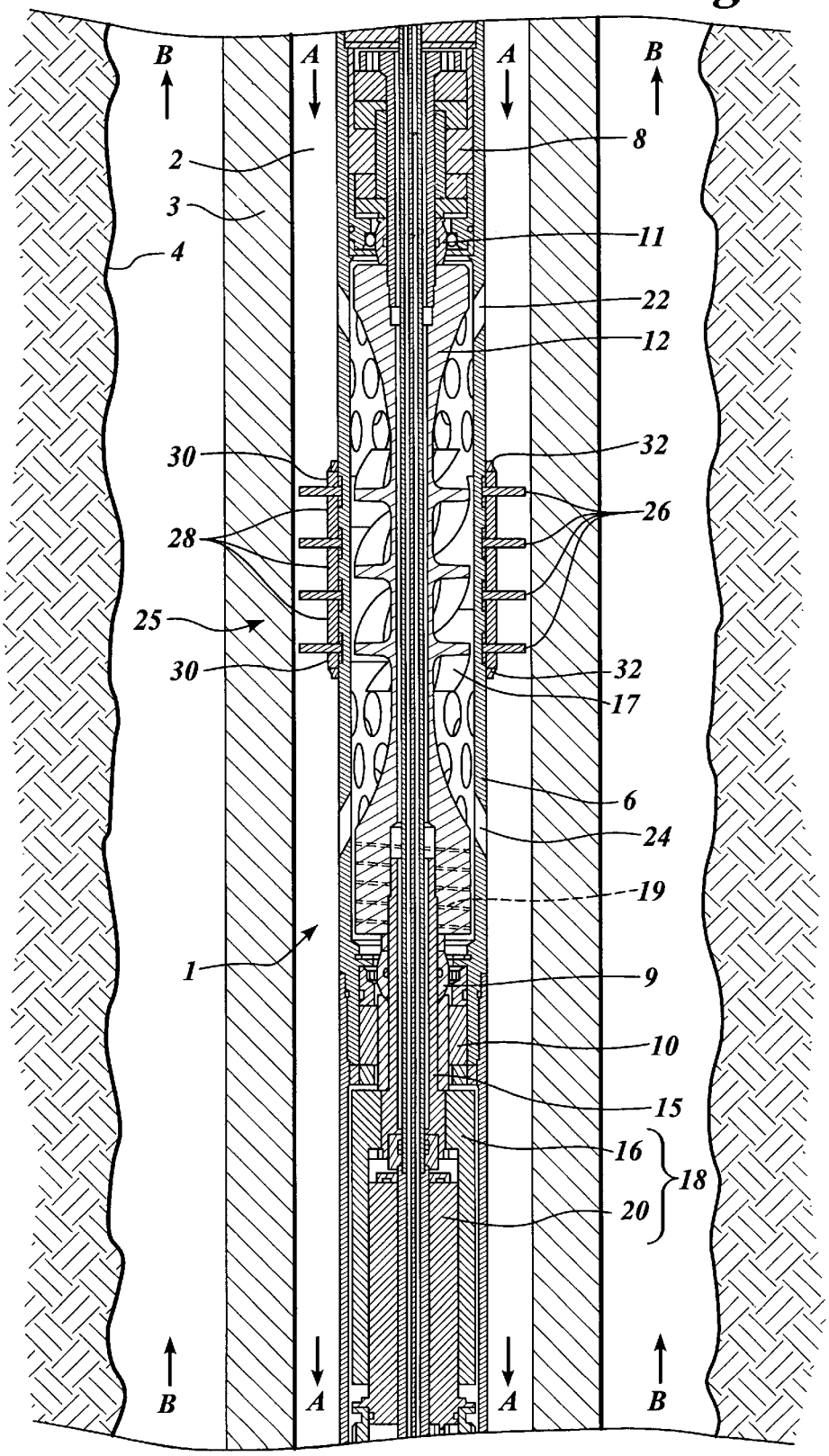
FIG. 1 is a cross-sectional view of an impeller device and a fluid-driven alternator according to the present invention.

A fluid-driven alternator I with an internal impeller according to the present invention is illustrated in FIG. 1. In this figure, the alternator 1 is shown within a drill string located in a downhole well bore. Generally speaking, the alternator is driven by mud, or drilling fluid, circulated through an annular flow path 2 (along the direction of arrows A) within a drill collar wall 3. The mud flows to the drill bit (unshown) and back to the surface via an annulus formed between the drill collar wall 3 and a borehole wall 4 (along the direction of arrows B). An MWD tool (unshown) is typically located in the drill string downhole of the alternator and closer to the drill bit. The MWD tool uses electricity generated by the alternator to provide drilling-related data.

Figure 2:
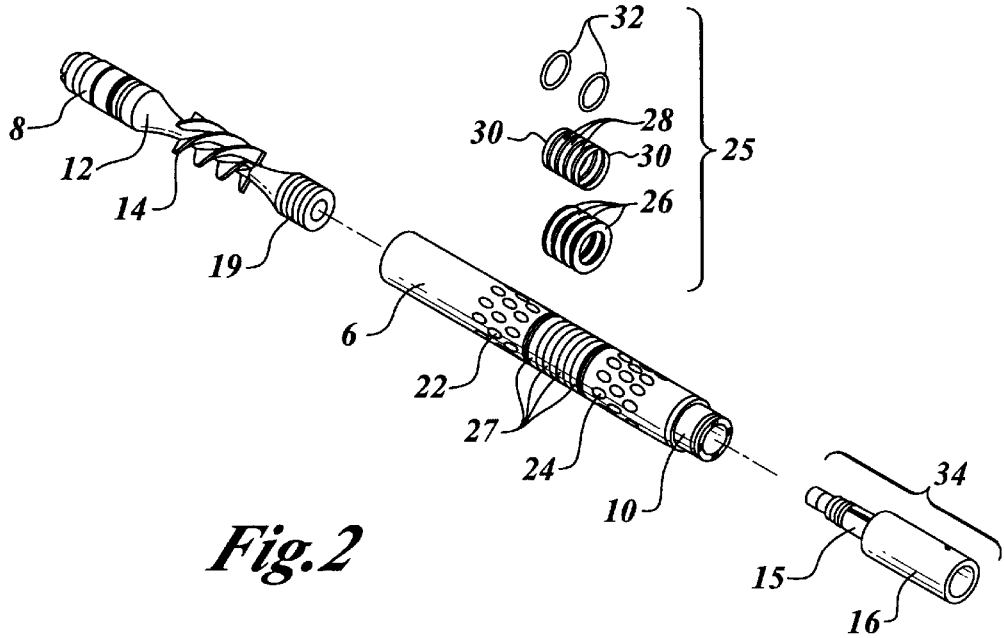
FIG. 2 is an exploded view of part of the fluid-driven alternator, including the impeller device, according to the present invention.

With reference primarily to FIGS. 1 and 2, the alternator according to the present invention includes a housing 6, containing an upper bearing assembly 8, a lower bearing assembly 10 and an impeller, or rotary turbine, 12. The impeller 12 is rotatably supported at its upper end by the upper bearing assembly 8 and at its lower end by the lower bearing assembly 10, and an upper seal 11 and a lower seal 9 are provided near the bearing assemblies to prevent mud from entering the bearings and alternator assembly (and contaminating a pressure-compensated oil bath). The impeller also has helical grooves 19 in its lower end to pump mud/debris away from the lower bearing assembly 10.

Figure 4:
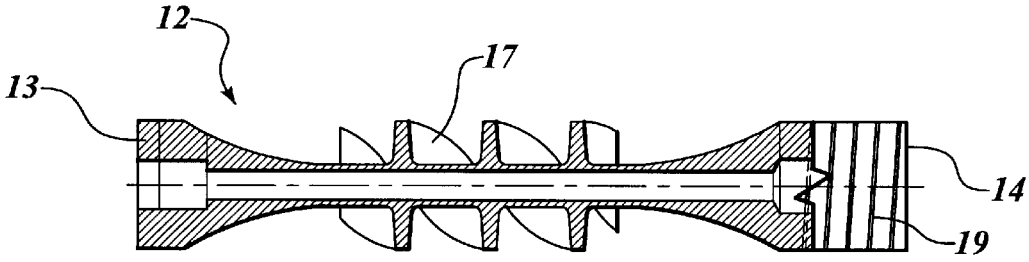
FIG. 4 is a side elevation, partly in cross-section, of an impeller according to the present invention.

As best seen in FIG. 4, the impeller itself has an upper end 13, a lower end 14 and at least one impeller blade 17. The impeller should be composed of a hard material that resists the wearing force of the mud flow. For example, the impeller may be composed of a steel alloy, such as 17-4PH stainless steel or STELLITE® alloy 6. Additionally, the impeller may be coated with a hard material, such as a ceramic or tungsten carbide coating, to help resist the wearing force of the mud flow.

As best seen in FIG. 2, in this embodiment the impeller 12 is coupled at its lower end to an alternator rotor 16 of an alternator assembly 18 by means of, for example, a rotor bolt 15. Of course, the alternator assembly could be provided above the impeller in the drill string, in which case the impeller would be coupled at its upper end to the rotor. The alternator assembly also has an alternator stator 20. As is known, relative movement between the rotor and stator generates electricity.

The impeller is rotatably driven by the circulating fluid flowing through the housing 6. This is accomplished by providing at least one and preferably a plurality of entrance openings 22 in the housing near the upper end of the impeller 12 and at least one and preferably a plurality of exit openings 24 in the housing near the lower end of the impeller 12. The circulating fluid enters the housing 6 through the entrance openings 22, passes over the impeller blade 17, and exits through the exit openings 24. The flow of fluid over the impeller blade 17 rotates the impeller 12 which in turn rotates, through the rotor bolt 15, the alternator rotor 16 of the alternator assembly 18. The housing 6 is preferably composed of similar materials as the impeller, and the openings in the housing 6 may also be coated with a hard material to reduce wear.

Another salient feature of the present invention is a flow diverter 25 located between the entrance openings 22 and the exit openings 24. The flow diverter restricts at least part of the annular flow path 2 and, by creating a pressure drop, encourages the fluid to flow into the housing 6 through the entrance openings 22, rather than continuing in the annular flow path 2 outside of the housing 6.

Figure 3A:
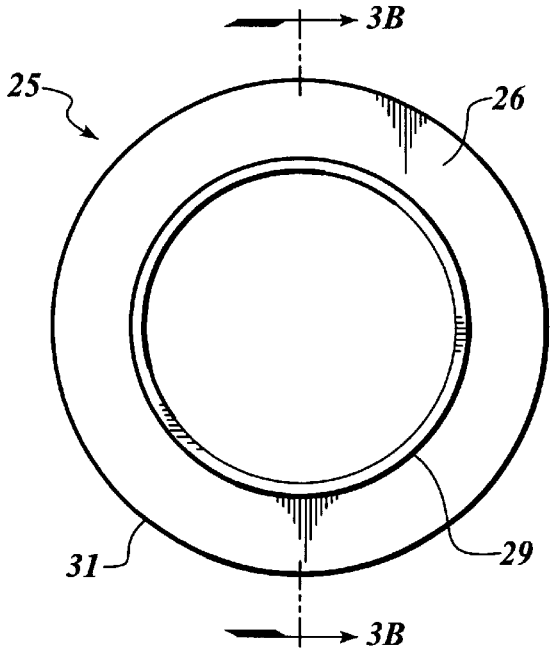
FIGS. 3A, 3B and 3C are views of a diverter ring according to the present invention.
Figure 3B:
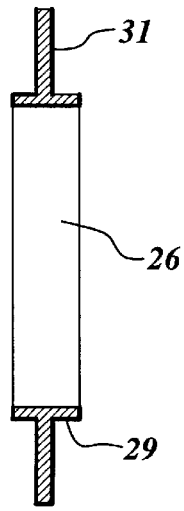
Figure 3C:
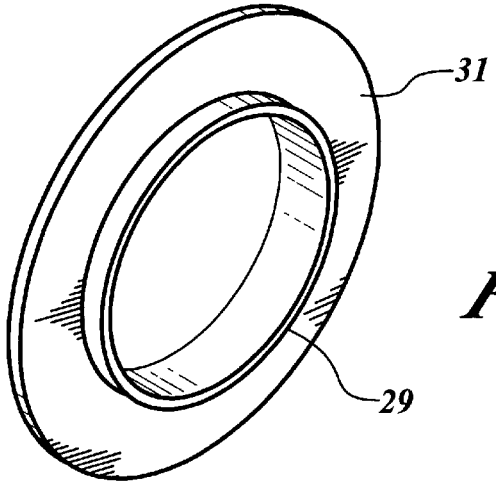

In the disclosed embodiment, four diverter rings 26 are removably secured to the exterior of the housing 6 between the entrance openings 22 and the exit openings 24. As shown in FIGS. 1 and 2, the rings 26 are seated in complimentary grooves 27 on the housing 6 and secured by inner retainer rings 28, outer retainer rings 30 and Smalley rings, or circlips, 32. Each diverter ring 26 is shown in FIGS. 3A, 3B and 3C to include a rim 29 that sits in the housing groove 27 and a diverter 31 that extends into the annular flow path 2 to divert the circulating mud. By removably attaching the diverter rings 26, they may be easily replaced in the field if worn or damaged. Alternatively, the diverter rings may be molded directly onto the housing.

While a rigid diverter ring would be capable of diverting the circulating mud, it is preferable that the diverter rings are composed of an elastomer material, such as VITON® (floced nitrile, 60–90 durometer). The inner and outer diverter retainers 28 and 30 are preferably composed of a metallic material such as beryllium copper. The Smalley rings 32 are preferably composed of a spring steel material.

One advantage of using an elastomer material is that when the tool assembly is retrieved, the elastomer rings can deflect and allow the tool assembly to be pulled through a restricted area in the drill string without being damaged. Another advantage of using an elastomer material is that as the force of the fluid on the rings increases with an increase in the fluid flow, the rings flex (deflect) and allow an increasingly greater flow area in the annular space. Thus, the velocity of the fluid flowing into the housing 6 can be regulated (i.e., limited). As a result, the alternator speed (rpm) flattens off at an upper end of the fluid flow range, becoming less than directly proportional to the flow rate, i.e., the alternator speed will not increase proportional to the flow rate of the circulating fluid. This will extend the useful flow range for a given impeller design with an upper rpm limit.

As shown in the figures, the disclosed flow diverter 25 uses a solid ring that extends into the annular flow path 2. As will be appreciated, however, alternative types of flow diverters that act to obstruct the flow of fluid in the flow path and encourage flow into the housing 6 can be used without departing from the scope of the invention. For example, the flow diverter may be a semi-circular ring or have notches or perforations therein. An inflatable device such as a balloon, or a protrusion extending from the housing or from the drill collar wall are also non-limiting examples of flow diverters that could be used.

The distance between the diverter and the drill collar wall 2 can also be selected to regulate the fluid flow. In a low fluid flow regime, e.g., 50–200 gallons/minute, the flow diverter can be sized to touch the drill collar wall so as to completely restrict, or occlude, the annular flow path. In a higher fluid flow regime, e.g., 200–600 gallons/minute, a gap can be left between the diverter and the drill collar wall to leave a bypass for some of the fluid. As will be appreciated, the characteristics of the flow diverter, e.g., size, shape, flexibility, etc., can be changed in order to achieve the desired fluid flow profile through the housing.

Where the impeller is internal to the housing of the alternator as described in the present invention, the diameter of the entire assembly may be reduced. In addition, providing a flow diverter will greatly increase the efficacy of the impeller, particularly when the flow diverter is made of an elastomer material. This allows the entire assembly to be removed from the drill string without damaging the impeller and without the assembly getting caught in the drill string.

Although specific embodiments of the present invention have been described above in detail, it will be understood that this description is merely for purposes of illustration. Various modifications of and equivalent structures corresponding to the disclosed aspects of the preferred embodiments, in addition to those described above, may be made by those skilled in the art without departing from the spirit of the present invention which is defined in the following claims, the scope of which is to be accorded the broadest interpretation so as to encompass such modifications and equivalent structures.

We claim:

1. A fluid-driven alternator for use in a downhole well bore having fluid flowing therethrough, said alternator comprising:

a housing;

a flow diverter for diverting flow into said housing;

an internal impeller rotatably mounted in said housing;

a stator mounted within said housing; and a rotor rotatably mounted in said housing and coupled to said impeller, wherein said fluid flowing through said housing rotates said impeller thereby rotating said rotor.

2. An alternator according to claim 1, wherein said housing includes at least one entrance opening through which the flowing fluid enters and at least one exit opening through which the flowing fluid exits.

3. An alternator according to claim 2, wherein said impeller includes at least one impeller blade and a drive shaft.

4. An alternator according to claim 2, wherein said flow diverter is positioned exterior of said housing and positioned between the entrance opening and exit opening, said flow diverter restricting fluid flow in a flow path along said housing and directing at least some of the flowing fluid into the entrance opening.

5. An alternator according to claim 4, wherein said flow diverter is made of an elastomer material.

6. An alternator according to claim 5, wherein said flow diverter comprises a ring.

7. An alternator according to claim 6, wherein said flow diverter is molded onto said housing.

8. An alternator according to claim 6, wherein said flow diverter is removably attached to said housing.

9. An alternator according to claim 5, wherein said flow diverter comprises a plurality of rings.

10. An alternator according to claim 9, wherein said rings are removably attached to said housing by retainers and clips.

11. An alternator according to claim 5, wherein said flow diverter can be deflected by the fluid flow to reduce the restriction and limit the amount of fluid flowing into the housing.

12. An alternator according to claim 1, wherein said impeller includes a helical groove on its lower end.

13. A fluid-driven alternator for use in a downhole well bore having fluid flowing therethrough, said alternator comprising:

a housing ;

an upper bearing assembly contained in said housing;

a lower bearing assembly contained in said housing;

an impeller contained in said housing, said impeller having an upper end, a lower end and at least one impeller blade, said impeller being rotatably supported at said upper end by said upper bearing assembly and at said lower end by said lower bearing assembly;

an alternator assembly comprising an alternator rotor and an alternator stator, with said alternator rotor coupled to said impeller;

at least one entrance opening in said housing near said upper end of said impeller; and at least one exit opening in said housing near said lower end of said impeller, wherein fluid enters said housing through said entrance opening, flows over said impeller blade, and exits said housing through said exit opening, and wherein the fluid flowing over said impeller blade rotates said impeller, which rotates said alternator rotor of said alternator assembly.

14. An alternator according to claim 13, wherein a plurality of impeller blades are provided on said impeller.

15. An alternator according to claim 13, wherein a plurality of entrance openings and a plurality of exit openings are provided in said housing, and wherein fluid enters said housing through said plurality of entrance openings, flows over said impeller blade, and exits said housing through said plurality of exit openings.

16. An alternator according to claim 13, further comprising at least one diverter ring exterior of said housing, said diverter ring restricting a fluid flow around said impeller device and diverting at least some of said fluid flow into said housing through said entrance opening.

17. An alternator according to claim 16, wherein said diverter ring comprises an elastomer material.

18. An alternator according to claim 17, wherein said diverter ring deflects as the force of the fluid flowing on said diverter ring increases with an increase in a flow of the fluid, and wherein the fluid flowing into the entrance opening of said housing flattens off at the upper end of a fluid flow range.

19. A fluid-driven alternator, retrievable through a downhole drilling string, comprising:

an internal impellor;

housing means for housing and rotatably mounting said internal impeller;

a flow diverter for diverting flow into said housing means; and alternator means, including a rotor and a stator, coupled to said internal impeller for generating electricity, wherein said internal impeller is rotated by fluid flowing Through said housing means and in turn rotates said rotor.

20. A fluid-driven alternator, retrievable through a downhole drilling string, comprising:

internal impeller means;

housing means for housing and rotatably mounting said internal impeller means;

flow diverter means for diverting flow into said housing means; and alternator means coupled to said internal impeller means for generating electricity, wherein said internal impeller means is rotated by a fluid flowing through said housing means and actuates said alternator means to generate the electricity.

* * * * *